United States Patent [19]

Holden et al.

[11] 4,055,108

[45] Oct. 25, 1977

[54] CRIMPER ASSEMBLY

[75] Inventors: Herbert K. Holden, Bon Air; Peter W. Mansfield, Richmond, both of Va.

[73] Assignee: American Filtrona Corporation, Richmond, Va.

[21] Appl. No.: 723,296

[22] Filed: Sept. 14, 1976

Related U.S. Application Data

[63] Continuation-in-part of Ser. No. 562,911, March 28, 1975, Pat. No. 4,007,668.

[51] Int. Cl.[2] ..... A24C 5/50

[52] U.S. Cl. ..... 93/1 C

[58] Field of Search ..... 93/1 C, 77 FT, 1 WZ

[56] References Cited

U.S. PATENT DOCUMENTS

| | | | |
|---|---|---|---|
| 2,786,399 | 3/1957 | Mason et al. | 93/1 C |
| 3,826,177 | 7/1974 | Berger et al. | 93/1 C |

FOREIGN PATENT DOCUMENTS

| | | | |
|---|---|---|---|
| 392,169 | 5/1933 | United Kingdom | 93/77 FT |

*Primary Examiner*—James F. Coan

*Attorney, Agent, or Firm*—Holman & Stern

[57] ABSTRACT

An improved crimper assembly for use in making crimped filter materials is disclosed. The improved features of the assembly include an insulated central heater block which incorporates a steam entrance housing. An anti-stuffing tube is provided in order to minimize the occasional wrapping of the crimper wheels by a rod of the filter material. Also provided are side plate bearing blocks which are insulated from the heater block. Other features include means for precision alignment and interchangeability of components.

4 Claims, 10 Drawing Figures

10
11
12
14
15
17
19
21
22
23
23a
23b
24
25
26
27
28
29
30
31
32
33
34
38
39
40
41
42
43
44
46
48
49
50
51
53
54
62
65
66

15°
31
69

39
28
29
45
15
71
70
24
34
31
40
32
14

28
68

FIG. 7
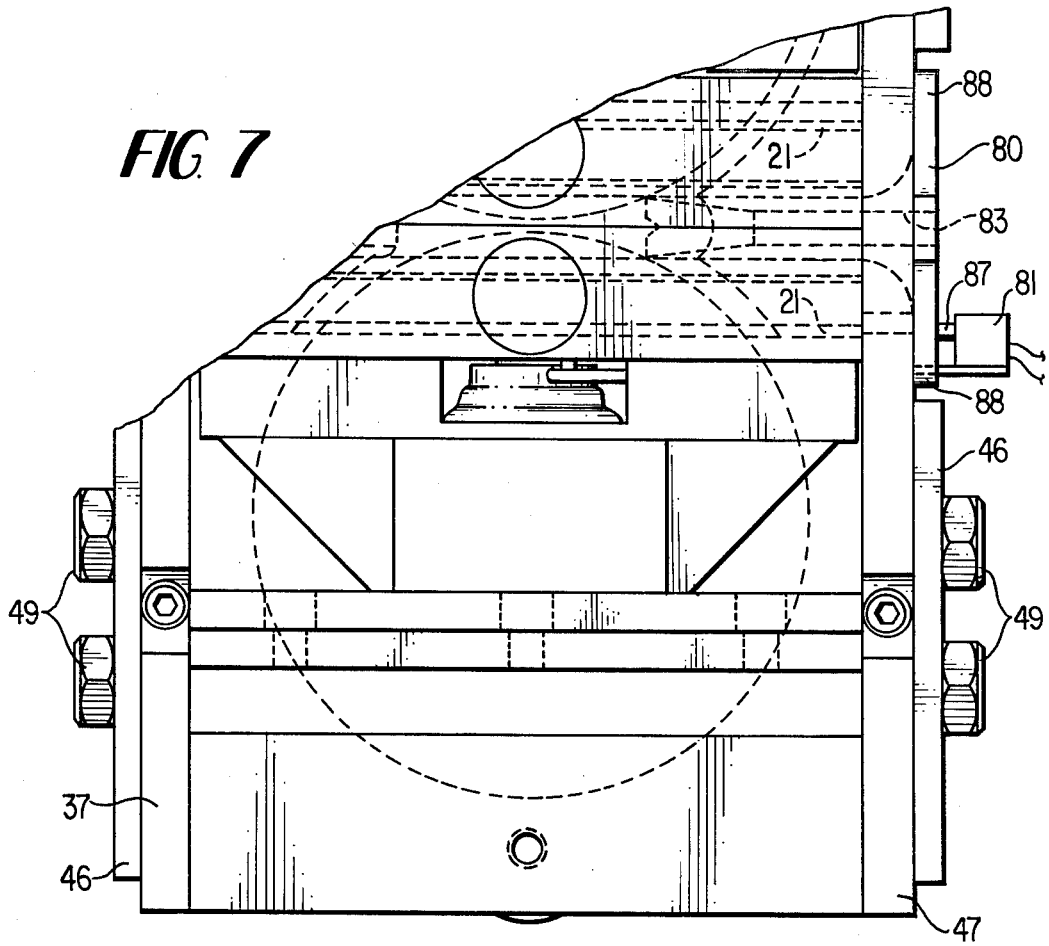
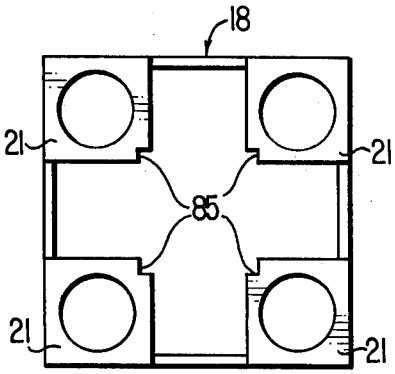
FIG. 10
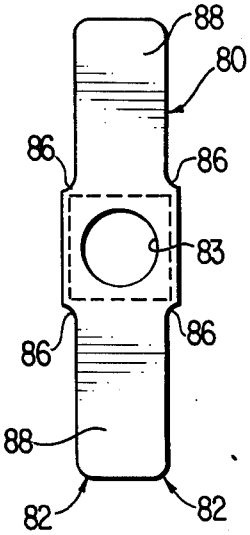
FIG. 9
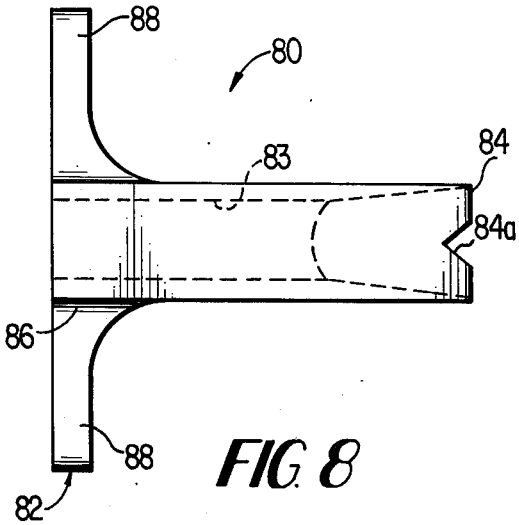
FIG. 8

CRIMPER ASSEMBLY

BACKGROUND AND SUMMARY OF THE INVENTION

This is a continuation-in-part of U.S. patent application Ser. No. 562,911, filed Mar. 28, 1975, now U.S. Pat. No. 4,007,668.

The present invention relates to an improved crimper assembly for use in making filter materials. More particularly, the present invention relates to an improved crimper assembly having features which provide excellent results in imparting a crimped configuration to a formed rod of filter material such as tobacco smoke filter elements.

Previous apparatus for crimping filter materials for use in the manufacture of cigarettes and the like have included, for example, a crimping assembly such as that described in U.S. Pat. No. 3,826,177, such an assembly including an arrangement of crimping wheels for imparting to the filter material a particular configuration.

By the present invention, there is provided an improved crimper assembly which has been found to allow operation at higher production speeds and to provide significantly longer life between refurbishment of such crimper apparatus. The crimper assembly of the present invention includes a separate insulated central heater block which incorporates the steam entrance housing of the crimper, and a means for accurately aligning this housing. Also provided in the improved crimper assembly of the present invention are separate side plate bearing blocks which are insulated from the heater block. The crimper assembly further includes provision for an alignment slot in the crimping wheels, thus allowing for precision alignment of the wheels during initial set-up, as well as during future refurbishment of the crimper assembly. Incorporated in the crimper assembly are eight bevel gears which provide positive interlock in a 360° circle.

The present crimper assembly includes a feature for minimizing the occasional wrapping of the crimper wheels by an improperly formed or crimped rod of filter material. This feature is in the form of an anti-stuffing tube which may be employed in conjunction with a cut-off switch for stopping operation of the crimper assembly in the event that the anti-stuffing tube fails to strip the fibrous rod cleanly from the crimping wheels.

Additional features of the present invention include a drive shaft with universal joint incorporating a shear pin which provides positive torque breakaway if the crimper should become locked due to the failure of the gears or obstruction of the wheels and a coupling shoulder bolt in combination with a slotted shaft providing compensation for lateral misalignment and quick change of crimper assembly on the machine bed. Eccentric nuts facilitate the adjusting of the assembled individual crimper blocks in two planes. This feature provides an accurate and easy means of achieving crimper wheel alignment of each of the four crimping wheels relative to the other wheels. The end plates of the present crimper assembly have been designed to provide a center hole on one end with pin dowel alignment on the other end, which will allow precision alignment of the heater block within the assembly.

BRIEF DESCRIPTION OF THE DRAWINGS

The advantages and features of the improved crimper assembly of the present invention will be more fully understood from the following detailed description of the preferred embodiments, taken in conjunction with the accompanying drawings, wherein:

FIG. 7 is a partial side elevational view of a second embodiment of the crimper assembly of the present invention;

FIG. 8 is a side view of the anti-stuffing tube employed in the embodiment of FIG. 7;

FIG. 9 is an end view of the anti-stuffing tube of FIG. 8; and

FIG. 10 is an end view of the heater block employed in the embodiment of FIG. 7.

DESCRIPTION OF THE PREFERRED EMBODIMENTS

Figure 1:
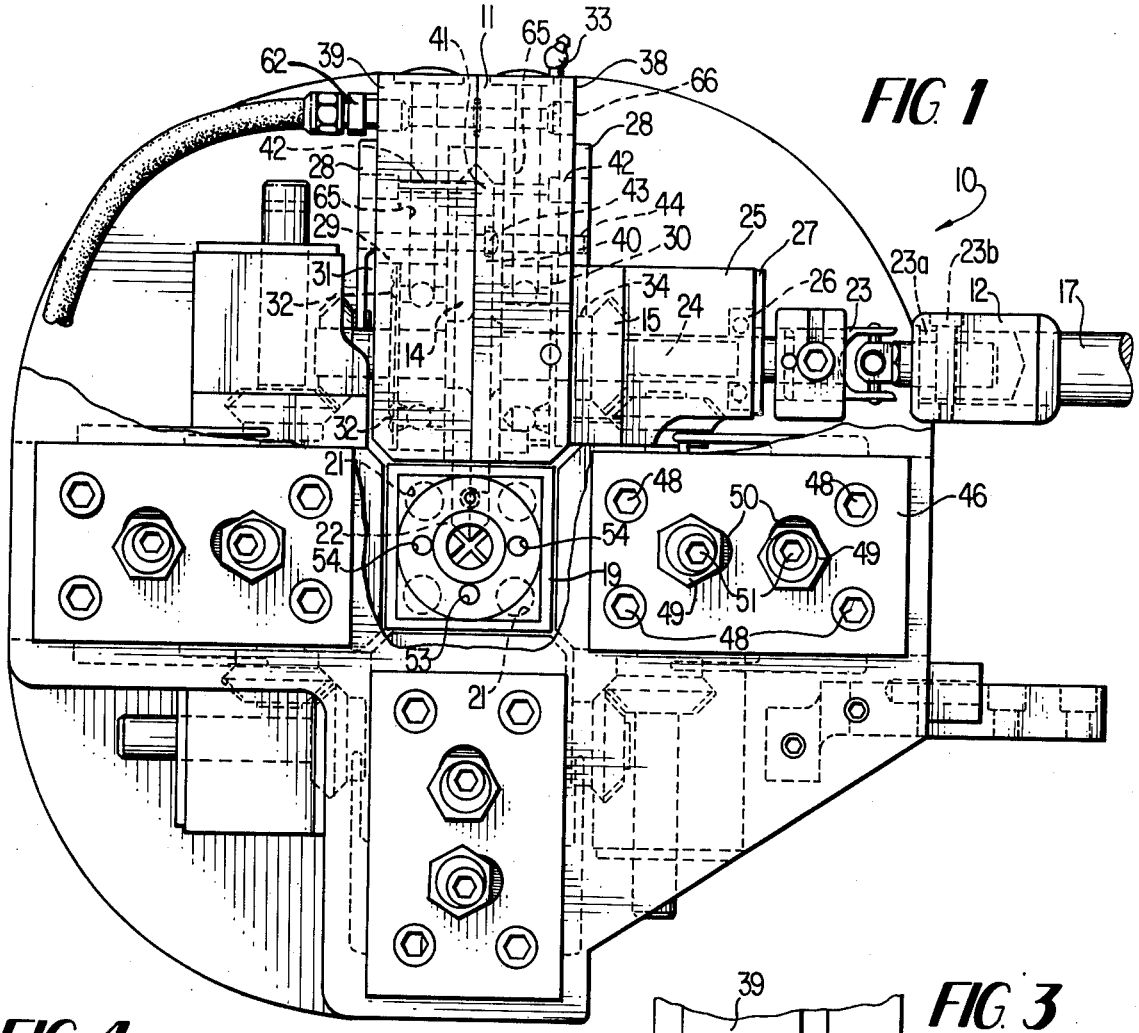
FIG. 1 is a partially broken-away vertical elevational view of the improved crimper assembly of the present invention.
Figure 2:
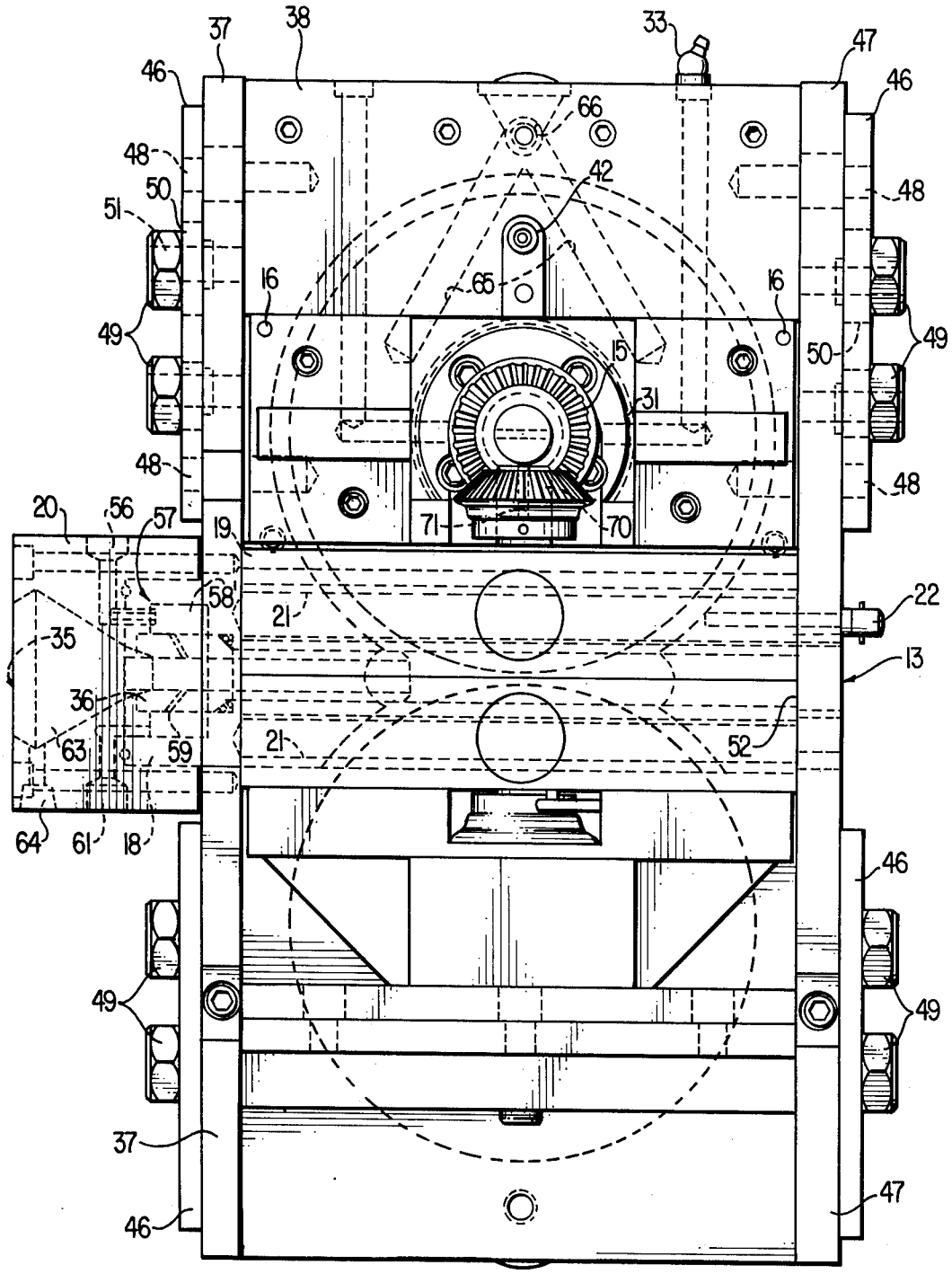
FIG. 2 is a side view of the crimper assembly shown in FIG. 1.

In the illustrated embodiment of the present invention as shown in FIGS. 1 through 6, apparatus is provided for imparting a crimped configuration to a formed rod of filtering material. In FIG. 1, the crimping assembly 10 is shown in detail in an elevational view, looking at the device from the front, or inlet end. The housing 11 is partially broken away for ease of illustration. A preconditioned rod of filter material (not shown) coming from a curing station, for example, enters the crimping assembly 10 at 35 (FIG. 2) and leaves the assembly at 13. In passing through the crimping assembly 10, the rod is intermittently contacted by the crimping wheels 14 which are arranged as two pairs of opposed wheels. The crimping wheels 14, which will be described more fully hereinafter, are driven by conventional means, such as bevel gears 15 which are interconnected by shafts 24 which, in turn, are powered by an external power source (not shown) through drive means 17. The crimping wheels 14 are mounted so that their peripheral portions extend into and are heated by a separately insulated, central heater block 18. As shown in FIG. 2, an end plate 37 is mounted at the inlet end of the assembly 10, with the heater block 18 centered and protruding through the end plate 37. A similar end plate 47 is mounted on the opposite end of the apparatus. A steam entrance housing 20 is attached to the outer face of the inlet end plate 37 by means such as bolts, the housing 20 being in fluid communication with steam insert 36 centered within the heater block 18. The heater block 18 incorporates four cartridge heaters (not shown) in longitudinal conduits 21.

Positioned around the heater block 18 is an insulation frame 19 which covers the entire longitudinal exterior surface of the heater block 18. This frame 19 may be formed of a glass filled epoxy material, for example. A temperature sensing thermocouple probe 22 is located within the block 18 in a position which allows highly accurate measurement and control of temperature in proximity to the point of use of the heat provided by the heater block 18 to heat the crimping wheels 14.

Each of the crimping wheels 14 comprises a plurality of axially projecting embossing portions and associated grooves circumferentially spaced around the periphery of the wheel 14. The particular configuration of the embossing portions is not important for the purposes of the present invention, and may correspond, for example, to the configuration as described in U.S. Pat. No. 3,826,177. Alignment slots 41 have been provided in the crimper wheels 14 to allow precision alignment of the wheels 14. As an additional improvement, the wheels 14 are preferably fabricated from heat hardenable steel and treated with an electro-deposition process which infuses pure chromium onto the surface of the metal treated, thus providing a low coefficient of friction and high wear surface giving greater wear life to the wheels 14. Such a process may be, for example, the process known as Armaloy, trademark of Armaloy Co. of North Carolina, Inc., which infuses 99% pure chromium onto the surface of the metal treated.

The separate insulated central heater block 18 incorporating the steam entrance housing 20 allows for concentration of the heat where needed, while also minimizing heat build-up in the side plate bearing blocks to achieve longer bearing life due to the absence of heat, and providing an improved location for the temperature sensing thermocouple probe 22 (FIG. 2) to provide closer control of the temperature at the point of use. The present heater block configuration also allows for precision alignment of the steam insert, as well as a means for directing condensation from the steam insert housing away from the rod being formed and directing this condensation away from other machine bed components, thus preventing them from being wetted.

Steam enters the steam entrance housing 20 from any suitable source of steam (not shown), passing through top opening 56 and through a steam nozzle 57 into a circumferential plenum chamber 58 (FIG. 2). The steam vapor passes through the eight equally spaced steam holes 59 angularly positioned in stream insert 36, while steam condensate passes out the bottom of the housing 20 through an opening 61, then through an ancillary needle control valve (not shown) to a condensate collection point removed from the apparatus 10. The needle valve is usually opened only slightly to allow escape of condensate with a very small amount of vapor, the latter only in sufficient quantity to assure that all condensate is being removed. The steam which enters the preformed fibrous rod of filter material should all condense on the fibrous rod, heating and conditioning the rod for subsequent crimping by the wheels 14. Any steam which escapes into the entrance chamber 63 of the housing 20 should condense and drain out the hole 64 at the bottom of the chamber 63.

The drive means for the crimper assembly 10 includes a jack shaft 12 connected by a universal joint 23 to drive shaft 24. 23 is slotted as shown in FIG. 1 at 23*a* to receive a coupling shoulder bolt 23*b* and which allows for lateral alignment of coupling crimper assembly to jack shaft 12. The shaft 24 extends through an outboard bearing block 25 which is aligned with the housing 11 by two precision taper pins 16 prior to bolting in place. The bearing block 25 houses a bearing 26 which is retained by a bearing retainer 27, the shaft 24 engaging the bearing 26 as it rotates. The shaft 24 then extends through a bevel gear 15 and a pair of bearings 29 mounted within the housing 11 on either side of a respective crimping wheel 14 and then through a second bevel gear 15 as seen in FIG. 1. The shaft 24 is secured to the respective crimping wheel 14 by any suitable means. A preferred securing means which serves to align each wheel 14 with the respective shaft 24 is the use of a pair of radial alignment slots 41 spaced at 180° on the face of the wheel 14. Prior to assembling the housing 11, bolts 43 are inserted through hub slots 40 of the drive shaft and loosely threaded into wheel 14. In making the initial alignment, these radial slots 41 are aligned with holes 42 extending through the side plate bearing blocks 38, 39. An alignment-locking rod (not shown) having a diameter slightly smaller than the width of the radial slot 41 is next passed through the hole 42 on one side, through the radial slot 41 and on into the hole 42 on the other side of the wheel 14, thus locking the wheel 14 in position. After torque is applied to drive shaft 12, an Allen wrench is then inserted through the hole 44 and the bolt 43 is tightened to a snug condition. The alignment rod is then removed, the wheel 14 turned 180° and the second bolt 43 is snugged. The wheel 14 is then rotated 90° and a third bolt 43 is snugged, then the wheel 14 is rotated 180° and the forth bolt 43 is snugged. Each bolt 43 is then returned to the hole 44 location and retightened securely, thus securing the shaft 24 to the crimping wheel 14.

A total of four shafts 24 are provided, each in conjunction with a respective outboard bearing block 25, as indicated in FIG. 1, with the result that these bearing block 25 and shaft 24 arrangements are interchangeable in any of the four positions within the crimper assembly 10. The jack shaft 12 imparts rotation to the drive shaft 24 with which it is in engagement, and through the system of bevel gears 15, all four of the crimping wheels 14 are driven in unison.

Figure 4:
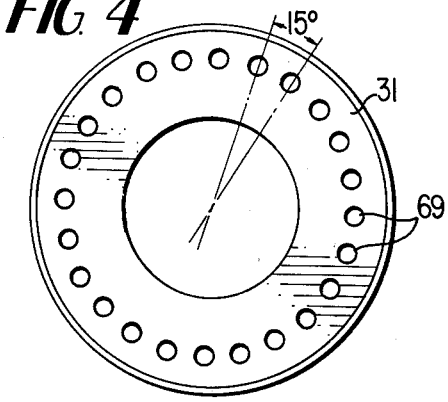
FIG. 4 is a plan view of a bearing retainer plate employed in the present invention.
Figure 3:
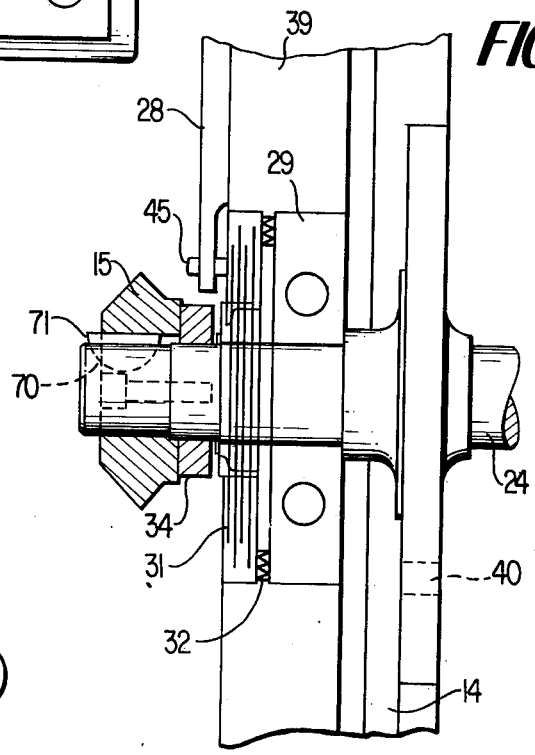
FIG. 3 is an enlarged view of a portion of the view shown in FIG. 1.
Figure 5:
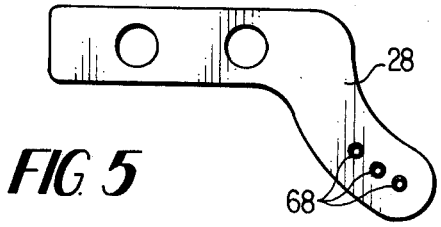
FIG. 5 is a plan view of a tension lock of the present invention.

As shown in FIGS. 1 and 3, in order to provide lubrication to both main bearings 29 on each side of the crimper wheel 14, a wavey washer thrust spring 32 is provided outwardly of bearing 29, in left side plate 39, followed by a bearing retainer plate 31, which allows for adjusting the thrust load on the wavey washer spring 32. A tension lock 28 allows for a positive locking of the bearing retainer plate 31. A plan view of the retainer plate 31 is shown in FIG. 4, while FIG. 5 shows a plan view of the tension lock 28.

The tension lock 28 operates to lock the bearing retainer plate 31 by means of a tension locking pin 45 which is screwed into one of the holes 68 of the tension lock 28. THe particular hole selected is that most nearly in line with one of the holes 69 of the bearing retainer plate 31, the retainer plate 31 being advanced or retarded to achieve the desired alignment.

The right side plate 38 contains a bearing 29 and outwardly is followed by a slotted bearing spacer 30 followed by a bearing retainer plate 31. The wavey washer thrust spring 32 on left side plate 39 and the bearing spacer 30 on right side plate 38 provide for fluid communication via the inlet lubrication channel, grease fitting 33 (shown only in the right side plate 38) and filling the bearing 29 ball cage with any excess relieved through the outlet lubrication channel on the left of side plate 38.

The improved separate side plate bearing configuration 38, 39 which is insulated from the heater block 18 as previously mentioned, includes the feature that larger and different type bearings 29 can be used which will take significantly greater thrust and radial loading, thereby providing longer bearing life and, particularly, longer life of bearing retainer cages. The side plate bearing blocks 38, 39 allow for unit assembly housing 11 to be interchangeable in any of the four positions within the crimper assembly. The side plate bearing blocks 38, 39 and the one-sided shielded bearings allow for periodic lubrication of the bearings 29 as well as for the possible use of a spring-loaded lubrication housing to provide lubrication to the bearings 29 when required. Cooling chambers 65 in the side plate bearing blocks 38, 39 make possible the use of a coolant which is passed into the chambers 65 which is in fluid communication with inlet hole 66 in side plate 38 and outlet hole 62 in side plate 39, to maintain a lower temperature of the bearings 29. Also, the side plate bearing blocks 38, 39 have been designed to enclose and protect the peripheral pattern of the crimper wheels 14. In addition, the outboard bearings blocks 25 provide additional bearing support of the crimper wheel shaft 24, thereby insuring more stable alignment and truer running of the crimper wheels 14 during operation. An outbosrd bearing block 25 and retainer plate 27 secures the outboard bearings 26.

The incorporation of the eight bevel gears 15 to provide a positive interlock in a 360° circle can be achieved with the gears 15 being adjusted into precision mesh by lock nuts 34 and held in mesh by the use of retaining screws that engage the lock nut 34 and the gears 15. A keyway 70 on shaft 24 and within gear 15 and a corresponding key 71 prevent rotational movement of the gear after the gear 15 is locked in place to the lock nut 34.

Plane alignment of the crimping wheels 14 is provided by the use of a base plate and eccentric nut arrangement. In making this alignment, a base plate 46 is overlayed onto the end plate 37, 47, as shown in FIGS. 1 and 2, with four corner holes of base plate 46 being positioned over four corresponding holes in the end plate 37, 47. As shown in the drawings, a base plate 46 is provided on both sides of the end plates 37, 47 retaining housing 11. A bolt 48 is passed down through each of the holes and is threaded into tapped holes in the side plates 38, 39 of housing 11. These bolts 48 are snugged, but not tight.

Figure 6:
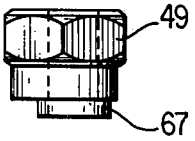
FIG. 6 is an elevation of an eccentric nut configuration employed in the present invention.

An eccentric nut 49, shown in FIG. 6, is fitted into each of the two center slots 50 of the base plate 46 and a bolt 51 is passed through the eccentric nut 49 and threaded snug into a tapped hole in the respective end plate 37, 47. The lower portion 67 of each nut 49 fits into the recess in the end plate. It is noted that each of the two slots 50 are oval-shaped, with the longitudinal axis of one slot 50 extending horizontally while that of the other slot 50 extends vertically relative to the base plate 46. The eccentric nuts 49 are then adjusted to move the housing 11 which includes the side plates 38, 39 into exact alignment so that the lobes of the wheels 14 have the desired position and clearance.

The heater block 18 may be aligned by the use of the hole 52 in the end thereof. An alignment pin (not shown) having a stepped diameter is inserted into the center hole 13 of the back end plate 47. The diameter of hole 13 is slightly larger than that of hole 52. The alignment pin is then passed into hole 52. A pin 53 is next inserted through the 180° positioned hole in the end plate 47 and into a matching hole in the heater block 18. The heater block 18 is thus locked in alignment and two additional bolts 54 are inserted into the 90° and 270° holes of the end plate 47 and securely tightened into a trapped hole of the heater block 18. The preceding, in conjunction with the centering and protrusion of the heater block through end plate 37 assures precise alignment of the fibrous body passage way through the crimper assembly.

In FIGS. 7 through 10, there is shown an alternative embodiment of the present apparatus, wherein an anti-stuffing tube device 80 is provided to minimize the occasional wrapping of the crimper wheels 14 by an improperly formed-crimped continuous fiber body. In normal operation, the continuous crimped fiber rod or body will release itself from the crimping wheels 14 as the wheels 14 discharge the fibrous rod. Occasionally, however, an improperly formed fibrous rod will hang on one or the other of the wheels 14 and begin to stuff itself into the space between the peripheral surface of a crimping wheel 14 and the heater block 18.

The apparatus as shown in FIGS. 7 through 10 is constructed so as to avoid this problem and also to avoid the loss of production and the expense of refurbishment which have accompanied this stuffing of the fibrous rod. The problem is alleviated by the use of an anti-stuffing tube 80 which is inserted into the heater block 18 as shown.

As shown in FIGS. 8 and 9, the anti-stuffing tube 80 is constructed with rounded corners 82 for ease of insertion and alignment within the end plate 47 at the exit end of the apparatus. A central bore 83 extends the length of the tube 80, gradually becoming wide toward the inner end 84 which will receive the fibrous rod as it emerges from the crimping wheels 14. V-shaped notches 84 *a* are provided on each of the four sides of the tube 80 at the inner end 84 so as to enable the anti-stuffing tube 80 to more closely mate with the crimping wheel 14 peripheral pattern as will be seen particularly in FIG. 7.

The heater block 18 is constructed with a cut-out portion or niche 85 in the inner edge of each of the heater conduits 21, as shown in FIG. 10. These niches 85 engage the four corners 86 on the central portion of the outer end of the tube 80. The end plate 47 should be constructed so that the opening therein will correspond with the opening in the heater block 18.

A conventional electrical cut-off switch 81, shown schematically in FIG. 7, is positioned downstream of the anti-stuffing tube 80 and directly adjacent the tube 80 so that any outward movement in a downstream direction by the tube 80 will result in contact of the tube 80 with switch detector arm 87, which in turn will activate the switch 81 and cut off power to the apparatus. Thus in the event that the anti-stuffing tube 80 fails to strip the fibrous rod cleanly from the crimping wheels 14, with the result that the rod engages the tube 80, the tube 80 will then be forced outwardly in a downstream direction so as to activate the cut-off switch 81. It should be understood that while it is shown in the drawings that the flanges 88 of the anti-stuffing tube 80 engage the switch detector arm 87, any portion of the anti-stuffing tube 80, or extension thereof could activate the cut-off switch 81 in an obvious manner. Moreover, the anti-stuffing tube 80, could be coupled, for example, to a cooling block (not shown) or any other convenient portion of the apparatus that would move with the anti-stuffing tube 80, and engage the switch detector arm 87. Thus, reference herein and in the appended claims to engagement of the switch activating means by the anti-stuffing tube 80 is intended to be understood to include any extension of the anti-stuffing tube 80 or any mechanism designed to move with the anti-stuffing tube 80.

In operation, the fibrous rod, upon emerging from contact with the crimping wheels 14, should continue to pass along the central portion of the apparatus and through the bore 83 of the anti-stuffing tube 80. In the event, however, that the fibrous rod is not stripped cleanly from the crimping wheels, the rod will make contact with the anti-stuffing tube 80, forcing the tube 80 outwardly and activating the switch 81, thus stopping the apparatus.

From the foregoing description, it is apparent that the subject crimper assembly includes many novel features which are highly advantageous for use in imparting a crimped configuration to any of various materials, including filter materials employed in the manufacture of cigarettes and the like.

It is thought that the invention and many of its attendant advantages will be understood from the foregoing description, and it will be apparent that various changes may be made in the form, construction and arrangement of the parts without departing from the spirit and scope of the invention or sacrificing all of its material advantages, the forms hereinbefore described being merely preferred embodiments thereof.

It is claimed:

1. In a crimping assembly for crimping a rod of fibrous material, said assembly having at least one pair of crimping wheels each having embossing means defined on its peripheral surface, means for rotatably supporting each pair of crimping wheels so as to juxtapose their respective embossing means and means for rotating each crimping wheel, the improvement comprising a separate central block extending axially through said crimping assembly from an upstream to a downstream location relative to said crimping wheels, said block having a longitudinally extending bore therein, an anti-stuffing tube inserted in said bore at the downstream location and having its inner end juxtaposed to said crimping wheels, and cut-out portions on said inner end generally corresponding in configuration to the surface pattern of said crimping wheels, said anti-stuffing tube having a central, longitudinally extending bore for receiving said rod of fibrous material so as to guide said rod along the bore of said central block and to prevent passage of said rod into the space between the peripheral surface of a crimping wheel and said central block.

2. The crimping assembly of claim 1, further including a cut-off switch located adjacent said anti-stuffing tube on the downstream side thereof and arranged so as to detect any outward movement of said tube in a downstream direction, said switch having means for cutting off power to said crimping assembly upon detection of such outward movement by said tube.

3. The crimping assembly of claim 1, wherein said central block is a heater block having a least one axially extending cartridge heater conduit located within said heater block for heating said crimping wheels.

4. The crimping assembly of claim 3, including a plurality of said cartridge heater conduits, each of said conduits having a cut-out portion which mates with a corresponding edge portion of said anti-stuffing tube.

* * * * *